US010452019B2

(12) United States Patent
Tamura

(10) Patent No.: US 10,452,019 B2
(45) Date of Patent: Oct. 22, 2019

(54) DRUM UNIT PROVIDED WITH AUGERS FOR CONVEYING WASTE TONER

(71) Applicant: Brother Kogyo Kabushiki Kaisha, Nagoya-shi, Aichi-ken (JP)

(72) Inventor: Hikaru Tamura, Handa (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 16/354,308

(22) Filed: Mar. 15, 2019

(65) Prior Publication Data

US 2019/0212691 A1 Jul. 11, 2019

Related U.S. Application Data

(62) Division of application No. 15/467,691, filed on Mar. 23, 2017, now Pat. No. 10,274,892.

(30) Foreign Application Priority Data

Mar. 31, 2016 (JP) ..... 2016-073102

(51) Int. Cl.
*G03G 21/10* (2006.01)
*G03G 15/01* (2006.01)

(52) U.S. Cl.
CPC ..... *G03G 21/105* (2013.01); *G03G 15/0194* (2013.01); *G03G 2221/1869* (2013.01)

(58) Field of Classification Search
None
See application file for complete search history.

(56) References Cited

U.S. PATENT DOCUMENTS

| | | | | |
|---|---|---|---|---|
| 7,127,207 | B2 | 10/2006 | Tsurusaki | |
| 2005/0058475 | A1 | 3/2005 | Tsurusaki | |
| 2007/0092290 | A1* | 4/2007 | Murakami | G03G 21/12 399/110 |
| 2014/0044463 | A1* | 2/2014 | Fukao | G03G 15/161 399/343 |
| 2014/0348561 | A1 | 11/2014 | Sato et al. | |
| 2015/0220022 | A1* | 8/2015 | Sakuma | G03G 15/0844 399/263 |

(Continued)

FOREIGN PATENT DOCUMENTS

| | | | |
|---|---|---|---|
| JP | H0545732 | U | 6/1993 |
| JP | H09-212053 | A | 8/1997 |

(Continued)

*Primary Examiner* — Sevan A Aydin
(74) *Attorney, Agent, or Firm* — Banner & Witcoff, Ltd.

(57) ABSTRACT

A drum unit includes: a photosensitive drum; a blade contacting a surface of the photosensitive drum and configured to remove waste toner therefrom; a first auger; and a second auger. The photosensitive drum defines an axis extending in a first direction and is rotatable about the axis. The first auger extends in the first direction. The first auger is rotatable upon receipt of a drive force from the photosensitive drum to convey the waste toner removed by the blade in the first direction. The second auger extends in a second direction crossing the first direction. The second auger is rotatable upon receipt of the driving force from the first auger to convey the waste toner conveyed by the first auger in the second direction.

3 Claims, 10 Drawing Sheets

(56) References Cited

U.S. PATENT DOCUMENTS

| | | | | |
|---|---|---|---|---|
| 2015/0277343 | A1* | 10/2015 | Hashimoto | G03G 21/105 399/358 |
| 2016/0109828 | A1 | 4/2016 | Sato et al. | |
| 2016/0334754 | A1* | 11/2016 | Hashimoto | G03G 21/105 |
| 2017/0108801 | A1 | 4/2017 | Nosho et al. | |
| 2017/0108802 | A1 | 4/2017 | Murakami et al. | |
| 2017/0115624 | A1* | 4/2017 | Hashimoto | G03G 21/105 |
| 2018/0011422 | A1 | 1/2018 | Sato | |

FOREIGN PATENT DOCUMENTS

| | | | |
|---|---|---|---|
| JP | 3075936 | U | 12/2000 |
| JP | 2005-049689 | A | 2/2005 |
| JP | 2006-058729 | A | 3/2006 |
| JP | 2006-133465 | A | 5/2006 |
| JP | 2006-139153 | A | 6/2006 |

* cited by examiner

DRUM UNIT PROVIDED WITH AUGERS FOR CONVEYING WASTE TONER

CROSS REFERENCE TO RELATED APPLICATION

This application is a divisional of prior U.S. application Ser. No. 15/467,691 filed on Mar. 23, 2017, which claims priority from Japanese Patent Application No. 2016-073102 filed on Mar. 31, 2016. The entire content of the priority application is incorporated herein by reference.

TECHNICAL FIELD

The present disclosure relates to a drum unit.

BACKGROUND

An electrophotographic image-forming apparatus, such as a so-called tandem-type image-forming apparatus having a plurality of photosensitive drums, is known in the art.

In such an image-forming apparatus, toner remaining on a surface of each photosensitive drum is configured to be removed by a corresponding one of cleaning devices.

For example, Japanese Patent Application Publication No. H09-212053 discloses that the toner removed by each cleaning device is configured to be conveyed into a corresponding branch pipe, and to be conveyed by a branch-pipe screw disposed in each branch pipe.

The toner conveyed by each branch-pipe screw is then configured to be collected in a common conveying pipe, and to be conveyed into a toner recovery container by a common-pipe screw disposed in the common conveying pipe.

SUMMARY

However, in the above-identified image-forming apparatus, a driving force from a motor provided in a main body is transmitted to each of the plurality of photosensitive drums, each of the plurality of branch-pipe screws, and the common-pipe screw through a gear train including bevel gears and spur gears, thereby rotating the plurality of photosensitive drums, the plurality of branch-pipe screws, and the common-pipe screw, respectively.

Thus, the above-described image-forming apparatus requires a complicated structure for rotating the plurality of branch-pipe screws, the common pipe screw, and the plurality of photosensitive drums.

In view of the foregoing, it is an object of the present disclosure to provide a drum unit having a simplified structure for conveying toner removed from a surface of a photosensitive drum.

In order to attain the above and other objects, there is provided a drum unit including a photosensitive drum, a blade, a first auger and a second auger. The photosensitive drum defines an axis extending in a first direction and is rotatable about the axis. The photosensitive drum has one end portion and another end portion opposite the one end portion in the first direction. The blade contacts a peripheral surface of the photosensitive drum and is configured to remove waste toner on the peripheral surface of the photosensitive drum therefrom. The first auger extends in the first direction and is rotatable upon receipt of a drive force from the photosensitive drum. The first auger is configured to convey the waste toner removed by the blade in the first direction. The second auger extends in a second direction crossing the first direction. The second auger is rotatable upon receipt of the driving force from the first auger and is configured to convey the waste toner conveyed by the first auger in the second direction.

According to another aspect, there is also provided a drum unit including a photosensitive drum, a blade, a first auger, a second auger and a rotatable body. The photosensitive drum defines an axis extending in a first direction and is rotatable about the axis. The photosensitive drum has one end portion and another end portion opposite the one end portion in the first direction. The blade contacts a peripheral surface of the photosensitive drum and is configured to remove waste toner on the peripheral surface of the photosensitive drum therefrom. The first auger extends in the first direction and is configured to convey the waste toner removed by the blade in the first direction. The second auger extends in a second direction crossing the first direction. The second auger is configured to convey the waste toner conveyed by the first auger in the second direction. The rotatable body is in contact with the one end portion of the photosensitive drum and is rotatable upon receipt of a driving force from the photosensitive drum. The second auger is rotatable upon receipt of the driving force from the rotatable body.

DETAILED DESCRIPTION

Hereinafter, a drum unit 1 according to an embodiment of the disclosure will be described with reference to FIGS. 1 through 7.

1. Details of the Drum Unit 1

Figure 1:
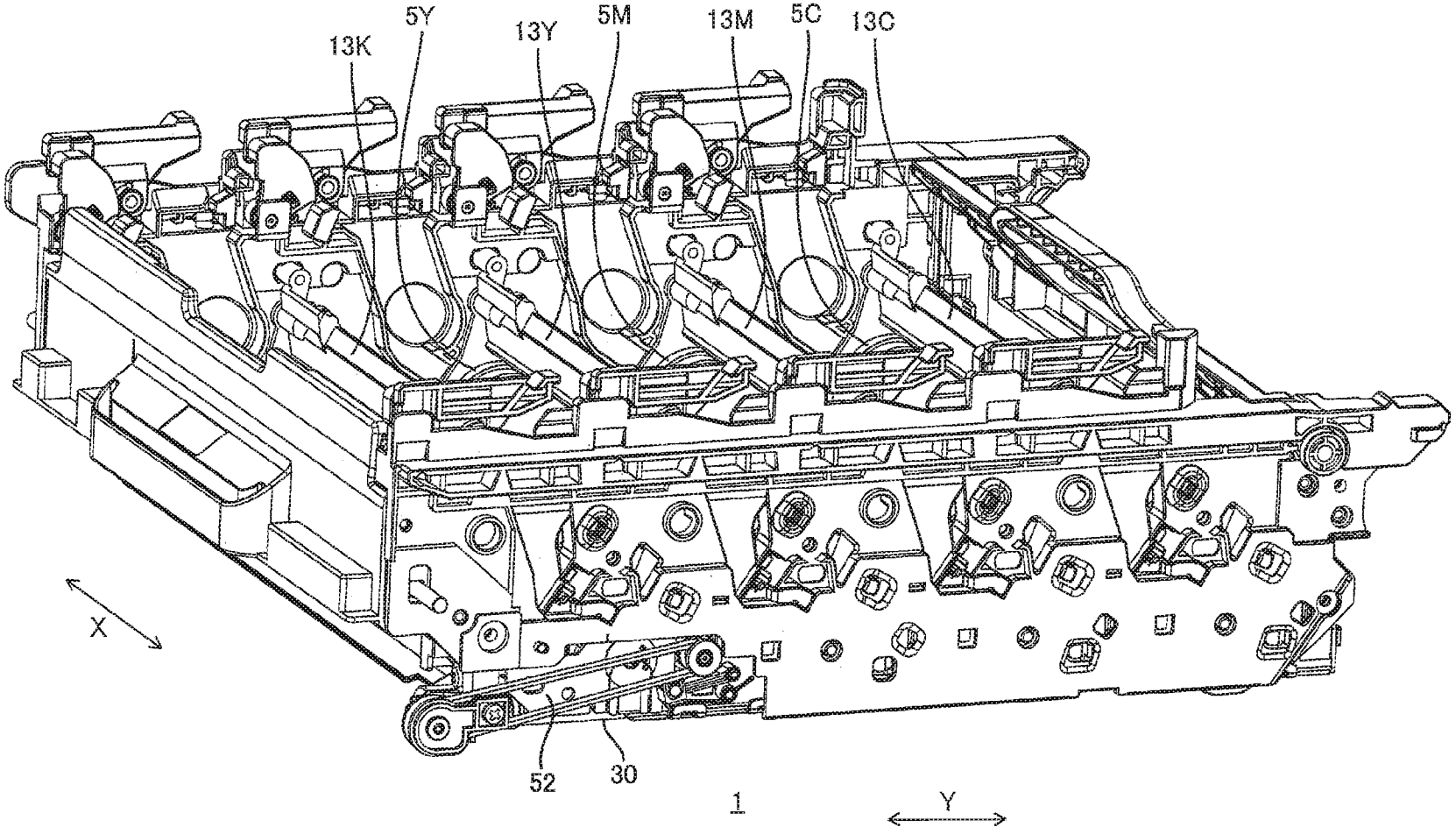
FIG. 1 is a perspective view of a drum unit according to an embodiment.
Figure 2A:
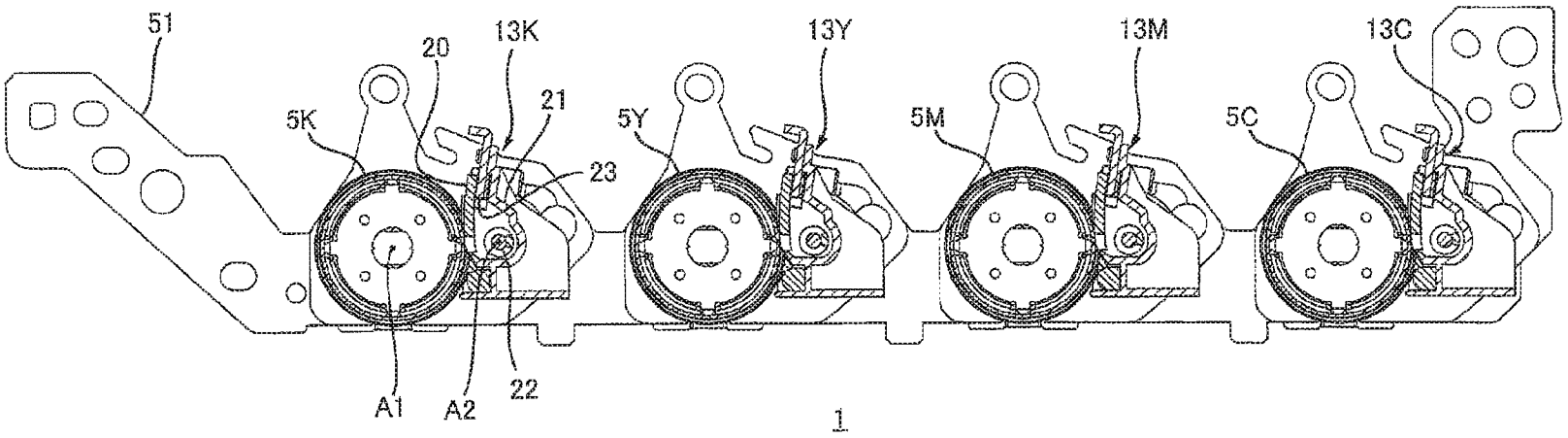
FIG. 2A is a central cross-sectional view of the drum unit according to the embodiment, wherein parts and components other than a photosensitive drum, a first side plate and a cleaning unit constituting the drum unit are not shown.
Figure 2B:
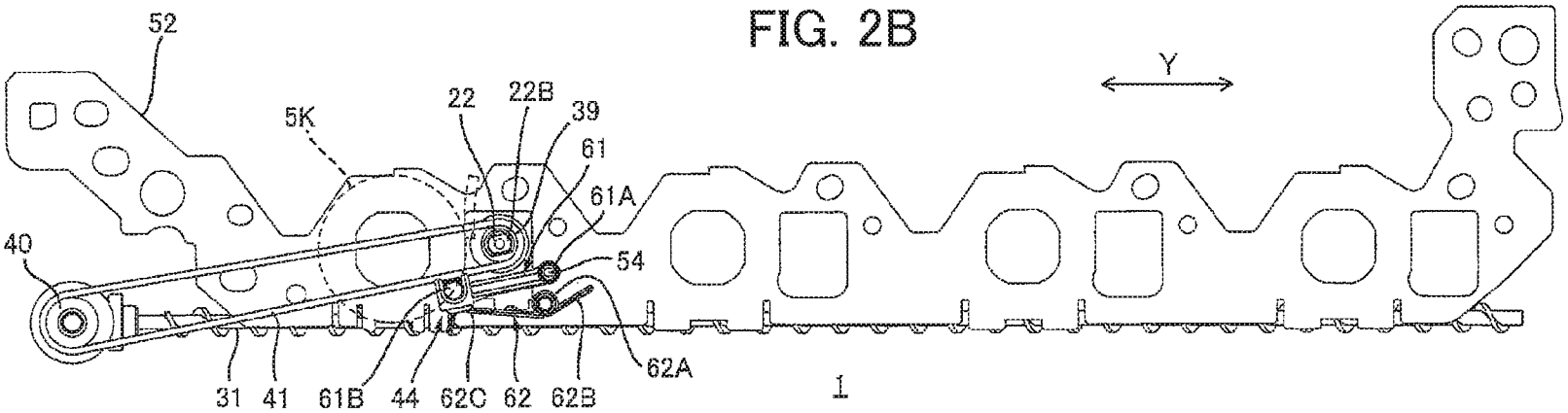
FIG. 2B is a side view of the drum unit according to the embodiment, wherein parts and components other than a second side plate, a conveyor auger, a first pulley, a second pulley, an endless belt and a contact member are not shown.

As illustrated in FIGS. 1, 2A, and 2B, the drum unit 1 includes a plurality of photosensitive drums (5K-5C), a first side plate 51, a second side plate 52, a plurality of cleaning units (13K-13C), a conveyor frame 30, and a conveyor auger 31.

1.1 Photosensitive Drums

Figure 3:
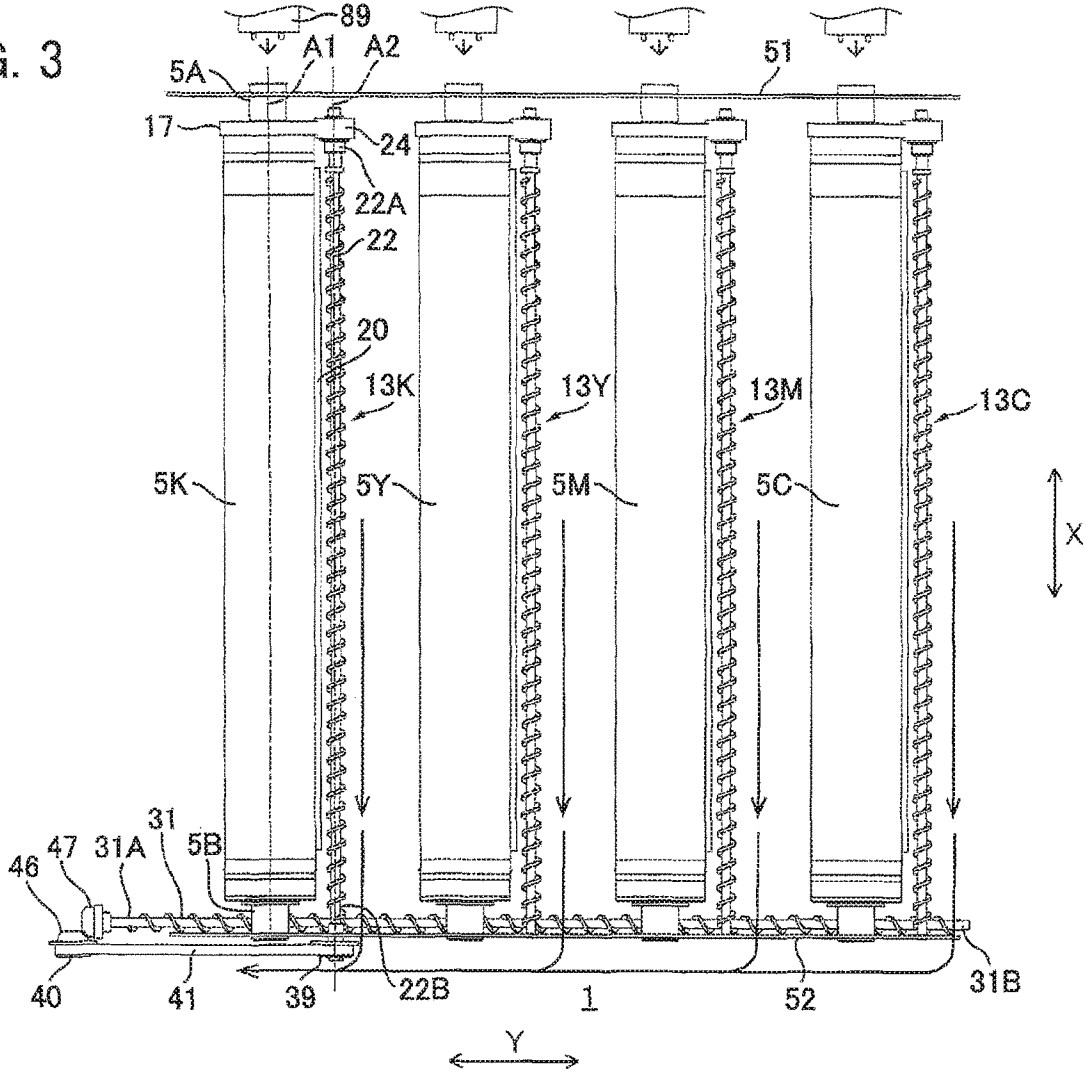
FIG. 3 is a schematic plan view explaining transmission of driving force and conveyance of waste toner in the drum unit according to the embodiment shown in FIG. 1.

Specifically, as illustrated in FIGS. 2A and 3, the plurality of photosensitive drums include a photosensitive drum 5K, a photosensitive drum 5Y, a photosensitive drum 5M, and a photosensitive drum 5C. The photosensitive drums 5K, 5Y, 5M, and 5C are juxtaposed in a direction crossing an axial direction X (axis A1) of the photosensitive drum 5K (hereinafter, referred to as a "crossing direction Y"). The photosensitive drums 5K, 5Y, 5M, and 5C are spaced apart from each other in the crossing direction Y.

The photosensitive drums 5K, 5Y, 5M, and 5C have the same structure as each other. Accordingly, in the following description, only the photosensitive drum 5K will be described in detail, while description on the photosensitive drums 5Y, 5M, and 5C will be omitted.

The photosensitive drum 5K is rotatable about the axis A1 extending in the axial direction X. The axial direction X is an example of a first direction. The photosensitive drum 5K has one end portion 5A and another end portion 5B opposite to the one end portion 5A in the axial direction X. As shown in FIG. 3, a coupling 89 of an image-forming apparatus 80 (see FIG. 7) is configured to be fitted to the one end portion 5A of the photosensitive drum 5K, thereby transmitting a driving force from the image-forming apparatus 80 to the photosensitive drum 5K through the coupling 89. The photosensitive drum 5K is rotatable upon receipt of the driving force from the image-forming apparatus 80.

The photosensitive drum 5K further includes a drum gear 17.

The drum gear 17 is provided coaxially on the one end portion 5A of the photosensitive drum 5K. The drum gear 17 is rotatable with the photosensitive drum 5K.

1.2 First Side Plate 51 and Second Side Plate 52

The first and second side plates 51 and 52 are spaced apart from each other in the axial direction X. The first side plate 51 supports the respective one end portions 5A of the photosensitive drums 5K, 5Y, 5M, and 5C. The second side plate 52 supports the respective other end portions 5B of the photosensitive drums 5K, 5Y, 5M, and 5C. The second side plate 52 is an example of a support member. As illustrated in FIGS. 2A and 2B, the first and second side plates 51 and 52 extend in the crossing direction Y. The first and second side plates 51 and 52 have a plate-like shape.

Figure 6:
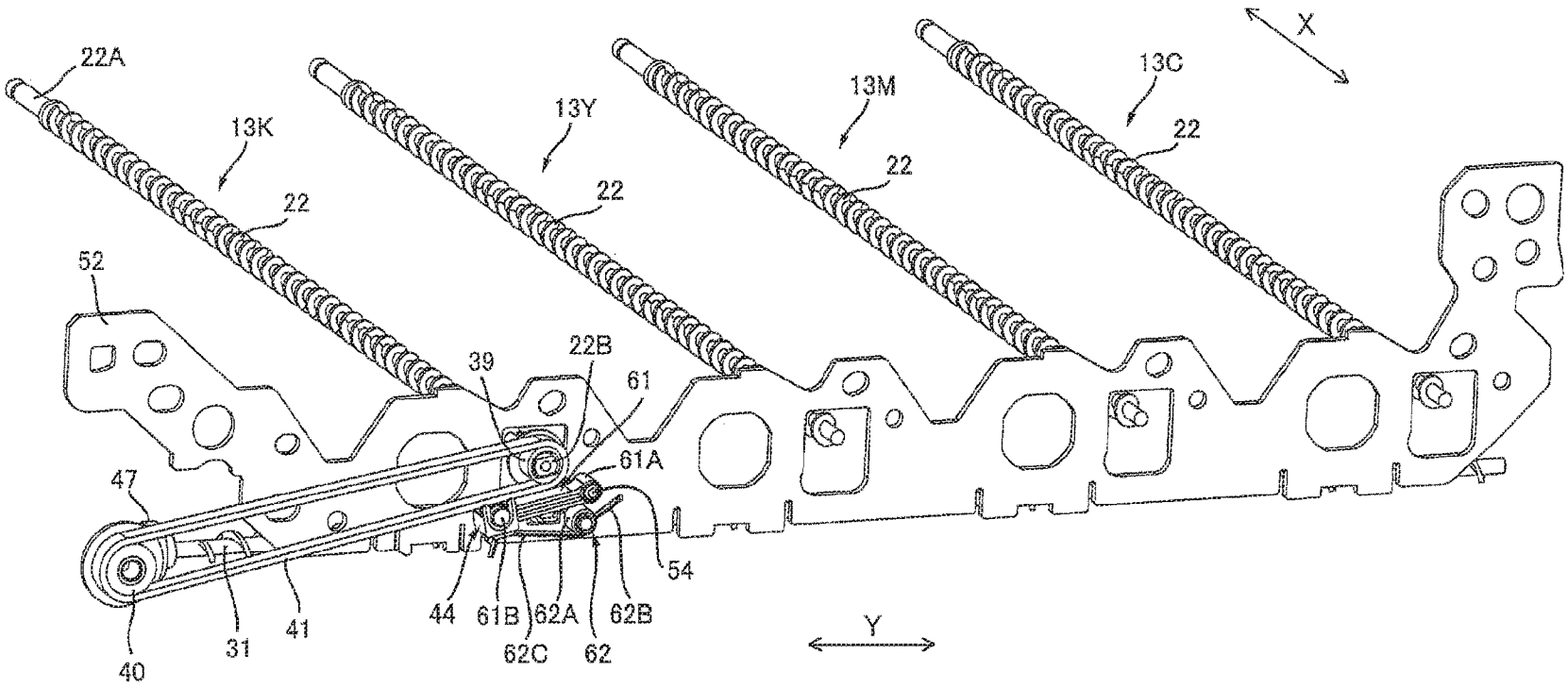
FIG. 6 is a schematic diagram explaining transmission of the driving force in the drum unit according to the embodiment shown in FIG. 1.

As illustrated in FIGS. 2B and 6, the second side plate 52 includes a boss 54.

The boss 54 is positioned opposite the photosensitive drum 5K with respect to an auger screw 22 (described later) of a cleaning unit 13K in the crossing direction Y. The boss 54 protrudes in the axial direction X from an outer surface of the second side plate 52. The boss 54 extends away from the first side plate 51 in the axial direction X. The boss 54 has a circular columnar shape.

1.3 Cleaning Units

Specifically, as illustrated in FIGS. 1 and 2A, the plurality of cleaning units include the cleaning unit 13K, a cleaning unit 13Y, a cleaning unit 13M, and a cleaning unit 13C. The cleaning units 13K, 13Y, 13M, and 13C are arrayed in the crossing direction Y. The cleaning units 13K, 13Y, 13M, and 13C are spaced apart from each other in the crossing direction Y. The cleaning unit 13K is disposed between the photosensitive drums 5K and 5Y in the crossing direction Y. The cleaning unit 13Y is placed between the photosensitive drums 5Y and 5M in the crossing direction Y. The cleaning unit 13M is placed between the photosensitive drums 5M and 5C in the crossing direction Y. The cleaning unit 13C is disposed opposite to the photosensitive drum 5M with respect to the photosensitive drum 5C in the crossing direction Y. The cleaning units 13K, 13Y, 13M, and 13C have the same structure as each other. Accordingly, in the following description, only the cleaning unit 13K will be described, while the cleaning units 13Y, 13M, and 13C will not be described.

The cleaning unit 13K includes a blade 20, a cleaning frame 21, and the auger screw 22.

1.3.1 Blade 20

As illustrated in FIGS. 2A and 3, the blade 20 extends in the axial direction X. The blade 20 is fixed in position relative to the photosensitive drum 5K. The blade 20 has a plate shape. The blade 20 is in contact with a peripheral surface of the photosensitive drum 5K. The blade 20 is configured to scrape off toner remaining on the peripheral surface of the photosensitive drum 5K as the photosensitive drum 5K rotates. The blade 20 is thus configured to remove the toner remaining on the peripheral surface of the photosensitive drum 5K (i.e. waste toner).

1.3.2 Cleaning Frame 21

The cleaning frame 21 extends in the axial direction X. The cleaning frame 21 has a substantially rectangular cylindrical shape. As shown in FIG. 2A, the cleaning frame 21 supports the blade 20. The cleaning frame 21 is formed with an opening 23.

Specifically, the opening 23 penetrates a wall of the cleaning frame 21, the wall facing the photosensitive drum 5K in the crossing direction Y. That is, the opening 23 faces the photosensitive drum 5K. The opening 23 extends across an entire dimension of the cleaning frame 21 in the axial direction X.

1.3.3 Auger Screw 22

The auger screw 22 is disposed within the cleaning frame 21. The auger screw 22 extends in the axial direction X. As illustrated in FIGS. 2A and 3, the auger screw 22 is rotatable about an axis A2 extending in the axial direction X. Preferably, as in the embodiment, the axis A2 is in parallel with the axis A1. The auger screw 22 of the cleaning unit 13K is an example of a first auger.

As illustrated in FIG. 3, the auger screw 22 has one end 22A and another end 22B opposite to the one end 22A in the axial direction X. That is, with respect to the axial direction X, the one end 22A of the auger screw 22 is positioned adjacent to the first side plate 51, while the other end 22B of the auger screw 22 is positioned adjacent to the second side plate 52.

The auger screw 22 further includes an auger gear 24.

The auger gear 24 is provided at the one end 22A of the auger screw 22. The auger gear 24 is fitted to the one end 22A of the auger screw 22. The auger gear 24 is rotatable together with the auger screw 22. The auger gear 24 meshes with the drum gear 17. With this structure, the auger screw 22 can rotate upon receipt of driving force from the photosensitive drum 5K.

1.4 Conveyor Frame 30 and Conveyor Auger 31

Figure 4:
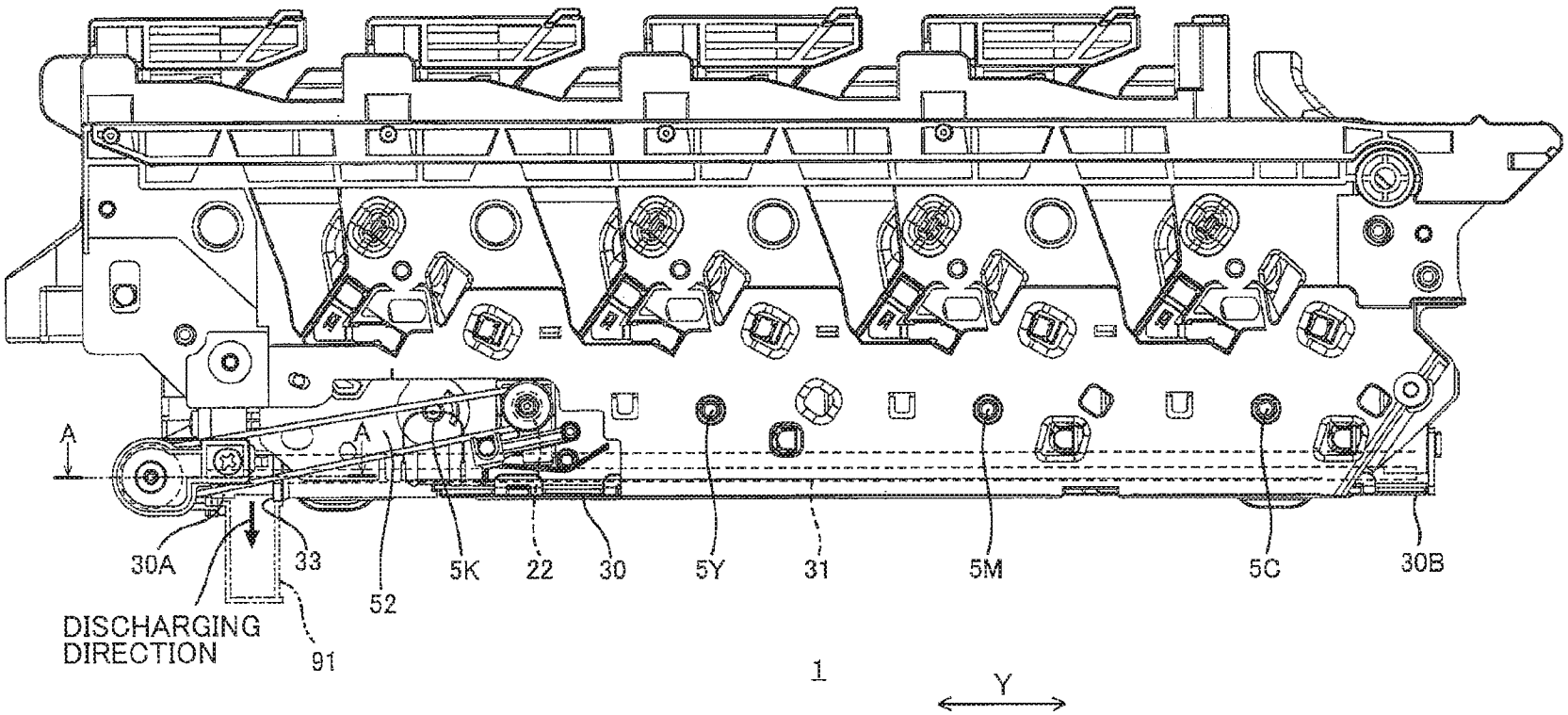
FIG. 4 is a side view of the drum unit according to the embodiment shown in FIG. 1.
Figure 5:
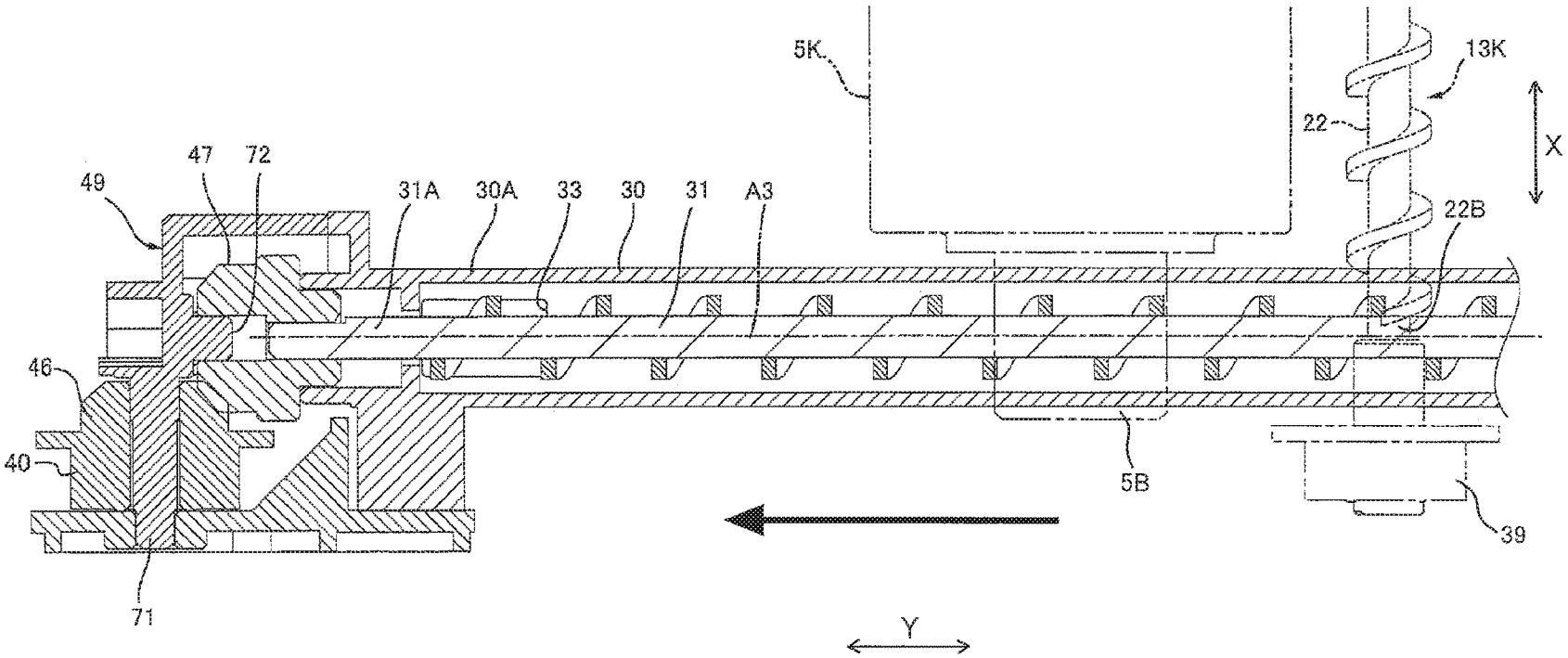
FIG. 5 is a partial cross-sectional view of an essential portion of the drum unit according to the embodiment taken along a plane A-A shown in FIG. 4.

As illustrated in FIGS. 1 and 4, the conveyor frame 30 is located adjacent to the second side plate 52 in the axial direction X. As illustrated in FIGS. 4 and 5, the conveyor frame 30 extends across an entire dimension of the drum unit 1 in the crossing direction Y. That is, the conveyor frame 30 extends in the crossing direction Y, i.e., in a direction crossing an extending direction of the auger screw 22. The conveyor frame 30 has one end portion 30A and another end portion 30B opposite to each other in the crossing direction Y. The one end portion 30A of the conveyor frame 30 is located opposite to the auger screw 22 with respect to the photosensitive drum 5K in the crossing direction Y. The other end portion 30B of the conveyor frame 30 is located opposite to the one end portion 30A thereof with respect to the photosensitive drums 5K, 5Y, 5M, and 5C in the crossing direction Y. The conveyor frame 30 has a substantially hollow cylindrical shape. The conveyor frame 30 is in communication with the cleaning frame 21, although the cleaning frame 21 of the cleaning unit 13K is not illustrated in FIG. 5. The one end portion 30A and the other end portion 30B of the conveyor frame 30 are closed. The conveyor frame 30 includes a discharge port 33.

The discharge port 33 is provided in the one end portion 30A of the conveyor frame 30. As shown in FIGS. 4 and 5, the discharge port 33 is positioned opposite to the auger screw 22 with respect to the photosensitive drum 5K in the crossing direction Y. The discharge port 33 penetrates a circumferential wall constituting the one end portion 30A of the conveyor frame 30. Preferably, as in the embodiment, the discharge port 33 penetrates a lower end portion of the circumferential wall constituting the one end portion 30A of the conveyor frame 30.

The conveyor auger 31 is disposed inside the conveyor frame 30. The conveyor auger 31 is an auger screw rotatable about an axis A3 extending in the crossing direction Y (see FIG. 5). That is, the conveyor auger 31 extends in a direction crossing the extending direction of the auger screw 22, i.e., in a direction crossing the axial direction X. The crossing direction Y is an example of a second direction. The conveyor auger 31 has one end 31A and another end 31B opposite to each other in the crossing direction Y. The one end 31A of the conveyor auger 31 is located opposite to the auger screw 22 with respect to the photosensitive drum 5K in the crossing direction Y. The other end 31B of the conveyor auger 31 is located opposite to the one end 31A thereof with respect to the photosensitive drums 5K, 5Y, 5M, and 5C in the crossing direction Y.

The conveyor auger 31 is configured to rotate to convey the waste toner within the conveyor frame 30 toward the one end portion 30A of the conveyor frame 30 from the other end portion 30B thereof in the crossing direction Y, as illustrated in FIG. 5. The conveyor auger 31 is an example of a second auger.

2. Structure for Transmitting Driving Force to Conveyor Auger 31

As illustrated in FIGS. 5 and 6, the drum unit 1 further includes a first pulley 39, a second pulley 40, an endless belt 41, a contact member 44, a first bevel gear 46, a second bevel gear 47, and a bearing 49.

2.1 First Pulley 39

As illustrated in FIGS. 3 and 6, the first pulley 39 is fitted to the other end 22B of the auger screw 22 of the cleaning unit 13K. The first pulley 39 is positioned opposite to the conveyor auger 31 with respect to the second side plate 52 in the axial direction X. The first pulley 39 is coaxial with the auger screw 22 of the cleaning unit 13K. The first pulley 39 is rotatable together with the auger screw 22 of the cleaning unit 13K. The first pulley 39 has a substantially circular cylindrical shape and extends in the axial direction X.

2.2 Second Pulley 40

The second pulley 40 is positioned opposite to the conveyor auger 31 with respect to the second side plate 52 in the axial direction X. The second pulley 40 is spaced apart from the first pulley 39 in the crossing direction Y. The second pulley 40 is positioned opposite to the cleaning units 13Y, 13M, and 13C with respect to the first pulley 39 in the crossing direction Y. As illustrated in FIGS. 5 and 6, the second pulley 40 has a substantially circular cylindrical shape and extends in the axial direction X. The second pulley 40 is rotatable.

2.3 Endless Belt 41

As illustrated in FIGS. 2B and 6, the endless belt 41 is mounted over the first pulley 39 and the second pulley 40. The endless belt 41 is configured to transmit driving force from the first pulley 39 to the second pulley 40.

2.4 Contact Member 44

The contact member 44 is supported by the second side plate 52 so as to be movable relative to the second side plate 52. Specifically, the contact member 44 is configured to apply tension to the endless belt 41 mounted over the first pulley 39 and the second pulley 40. The contact member 44 is disposed opposite to the first side plate 51 with respect to the second side plate 52 in the axial direction X. The contact member 44 includes a rod 61 and a spring 62.

The rod 61 is arranged adjacent to the first pulley 39. Preferably, as in the embodiment, the rod 61 is arranged below the first pulley 39. The rod 61 has a base end portion 61A and a distal end portion 61B.

The base end portion 61A is positioned opposite to the second pulley 40 with respect to the first pulley 39 in the crossing direction Y. The base end portion 61A extends in the axial direction X. The base end portion 61A has a circular cylindrical shape. The base end portion 61A is rotatably fitted to the boss 54 of the second side plate 52. Accordingly, the rod 61 is supported by the second side plate 52 so as to be pivotably movable about the boss 54.

The distal end portion 61B is positioned opposite to the base end portion 61A with respect to the first pulley 39 in the crossing direction Y. That is, the distal end portion 61B is disposed between the first pulley 39 and the second pulley 40 in the crossing direction Y. The distal end portion 61B extends in the axial direction X. The distal end portion 61B has a circular columnar shape. The distal end portion 61B can make contact with the endless belt 41. Specifically, the rod 61 is configured to contact the endless belt 41 at a position between the first pulley 39 and the second pulley 40.

The spring 62 is provided opposite to the first pulley 39 with respect to the rod 61. The spring 62 is an example of an urging member. The spring 62 has a coil portion 62A, one end portion 62B, and another end portion 62C.

The coil portion 62A is provided by winding a wire constituting the spring 62. The coil portion 62A is supported by the second side plate 52.

The one end portion 62B is an end portion of the wire constituting the spring 62. The other end 62C is another end portion of the wire constituting the spring 62. In the spring 62, the other end portion 62C and the one end portion 62B are positioned opposite to each other with respect to the coil portion 62A.

The one end portion 62B extends from the coil portion 62A in a direction away from the other end portion 62C. The one end portion 62B is fixed to the second side plate 52.

The other end 62C extends from the coil portion 62A toward the distal end portion 61B of the rod 61 and is in contact with the distal end portion 61B. With this structure, the spring 62 normally applies an urging force to the distal end portion 61B of the rod 61 toward the endless belt 41. The distal end portion 61B of the rod 61 is thus pressed against the endless belt 41 by the urging force of the spring 62. Tension can be thus applied to the endless belt 41, thereby suppressing loosening of the endless belt 41.

2.5 First Bevel Gear 46

As illustrated in FIGS. 3 and 5, the first bevel gear 46 is integral with the second pulley 40. The first bevel gear 46 extends from the second pulley 40 toward the conveyor auger 31 (more specifically, toward the one end 31A) in the axial direction X. The first bevel gear 46 has a substantially circular truncated conical shape that is tapered as extending away from the second pulley 40 in the axial direction X. The first bevel gear 46 extends in the axial direction X. The first bevel gear 46 is rotatable together with the second pulley 40.

2.6 Second Bevel Gear 47

The second bevel gear 47 is fitted to the one end 31A of the conveyor auger 31. The second bevel gear 47 is positioned opposite to the auger screw 22 of the cleaning unit 13K with respect to the photosensitive drum 5K in the crossing direction Y. The second bevel gear 47 is rotatable together with the conveyor auger 31. The second bevel gear 47 has a substantially circular truncated conical shape that is tapered as extending away from the photosensitive drum 5K in the crossing direction Y. The second bevel gear 47 extends in the crossing direction Y. The second bevel gear 47 meshes with the first bevel gear 46.

2.7 Bearing 49

As illustrated in FIG. 5, the bearing 49 rotatably supports the second pulley 40, the first bevel gear 46, and the second bevel gear 47. Specifically, the bearing 49 is disposed opposite to the discharge port 33 with respect to the one end 31A of the conveyor auger 31 in the crossing direction Y. The bearing 49 has a first support shaft 71 and a second support shaft 72.

The first support shaft 71 has a circular columnar shape. The first support shaft 71 extends toward the first bevel gear 46 in the axial direction X. The first support shaft 71 is fitted to the first bevel gear 46. The first support shaft 71 rotatably supports the second pulley 40 and the first bevel gear 46 integrally formed with the second pulley 40.

The second support shaft 72 has a circular columnar shape. The second support shaft 72 extends toward the conveyor auger 31 in the crossing direction Y. The second support shaft 72 is fitted to the second bevel gear 47. The second support shaft 72 rotatably supports the second bevel gear 47.

Since the bearing 49 supports the second pulley 40, the first bevel gear 46, and the second bevel gear 47, the first bevel gear 46 and second bevel gear 47 can be arranged with high accuracy. As a result, the first bevel gear 46 and second bevel gear 47 can reliably intermesh with each other, resulting in reliable transmission of driving force from the auger screw 22 of the cleaning unit 13K to the conveyor auger 31.

3. How to Use the Drum Unit 1

Figure 7:
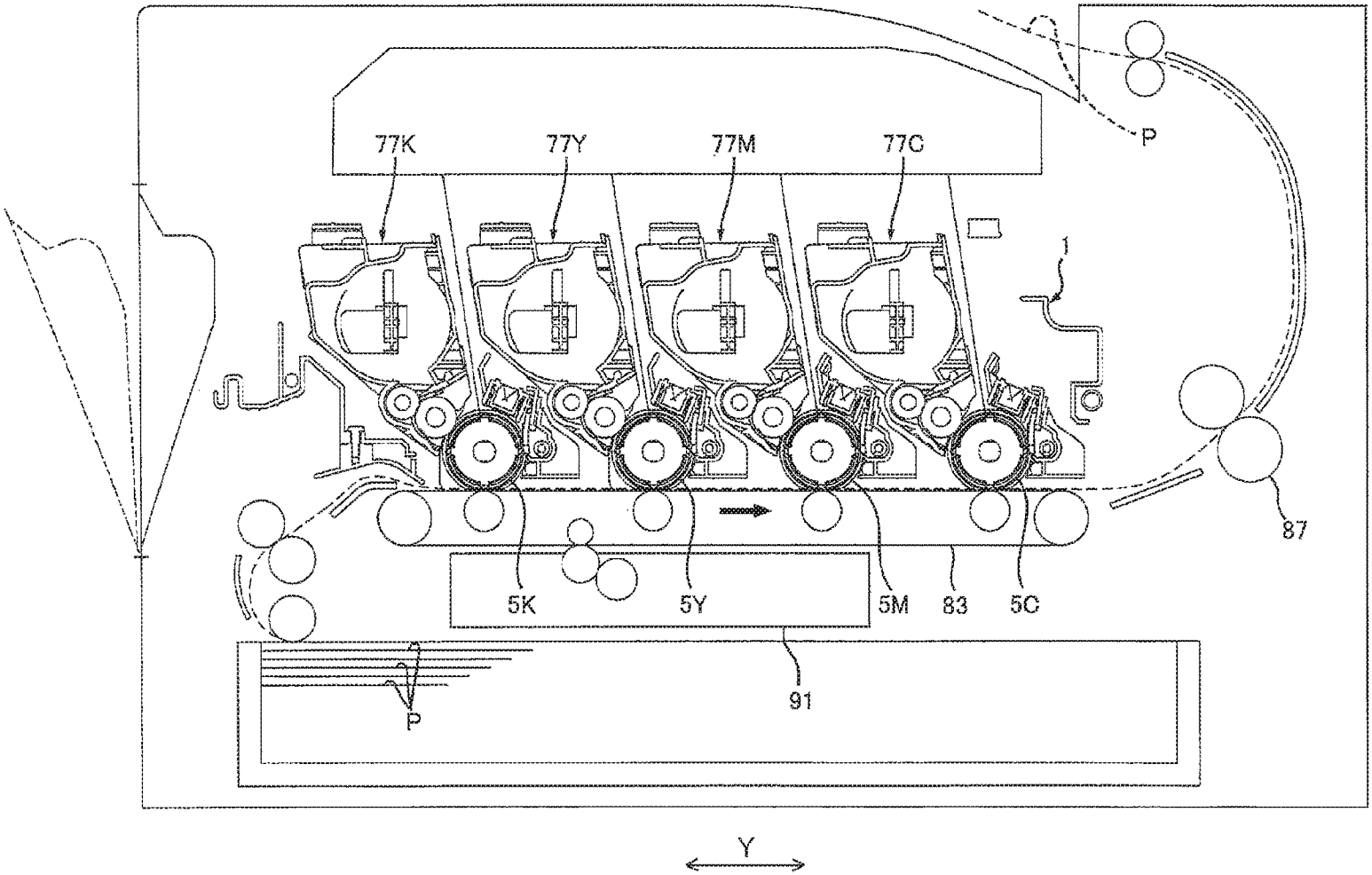
FIG. 7 is a central schematic cross-sectional view of an image-forming apparatus in which the drum unit according to the embodiment is mounted.

As illustrated in FIG. 7, a plurality of developing cartridges (77K-77C) is mountable in the drum unit 1. The drum unit 1 with the developing cartridges mounted therein is attached to the image-forming apparatus 80 to be used thereby.

3.1 Developing Cartridges

The plurality of developing cartridges is individually detachably mountable in the drum unit 1. Specifically, the plurality of developing cartridges includes a developing cartridge 77K, a developing cartridge 77Y, a developing cartridge 77M, and a developing cartridge 77C. The developing cartridges 77K, 77Y, 77M, and 77C are juxtaposed in the crossing direction Y when mounted in the drum unit 1. The developing cartridges 77K, 77Y, 77M, and 77C mounted in the drum unit 1 are arranged to be spaced apart from each other in the crossing direction Y. The developing cartridge 77K stores black toner therein. The developing cartridge 77Y stores yellow toner therein. The developing cartridge 77M stores magenta toner therein. The developing cartridge 77C stores cyan toner therein. The developing cartridges 77K, 77Y, 77M, and 77C have the same structure as each other.

Each of the developing cartridges 77K-77C includes a casing and a developing roller for supplying the toner stored in the casing to the corresponding one of the photosensitive drums 5K-5C. The casing accommodates toner of a corresponding color therein. The developing roller is configured to supply the toner in the casing to the corresponding one of the photosensitive drums 5K-5C.

3.2 Image-Forming Apparatus 80

The image-forming apparatus 80 includes a conveyor belt 83, a fixing device 87, and a waste toner container 91.

3.2.1 Conveyor Belt 83

The conveyor belt 83 is disposed inside the image-forming apparatus 80. Specifically, the conveyor belt 83 is disposed below the drum unit 1 when the drum unit 1 is attached to the image-forming apparatus 80. The conveyor belt 83 is configured to make contact with each of the photosensitive drums 5K-5C, i.e., the photosensitive drums 5K, 5Y, 5M, and 5C. The conveyor belt 83 is configured to convey a sheet of paper P thereon such that the sheet P sequentially makes contact with the photosensitive drum 5K, the photosensitive drum 5Y, the photosensitive drum 5M, and the photosensitive drum 5C, respectively. A toner image is transferred onto the sheet P while the sheet P is conveyed by the conveyor belt 83.

3.2.2 Fixing Device 87

The fixing device 87 is disposed inside the image-forming apparatus 80. The fixing device 87 is positioned downstream of the conveyor belt 83 in a conveying direction of the sheet P by the conveyor belt 83 (indicated by a thick arrow in FIG. 7). The fixing device 87 is configured to thermally fix the toner image, which was transferred onto the sheet P, to the sheet P.

3.2.3 Waste Toner Container 91

The waste toner container 91 is disposed inside the image-forming apparatus 80. The waste toner container 91 is placed opposite to the drum unit 1 with respect to the conveyor belt 83 when the drum unit 1 is attached to the image-forming apparatus 80. The waste toner container 91 is configured to store the waste toner removed from the peripheral surfaces of the respective photosensitive drums 5K-5C (also see FIG. 4).

4. Conveyance of Waste Toner

The photosensitive drum 5K is rotated upon receipt of the driving force from the coupling 89 (see FIG. 3).

As shown in FIG. 3, since the auger gear 24 meshes with the drum gear 17, the auger screw 22 is rotated by the driving force received from the photosensitive drum 5K.

As shown in FIGS. 2A and 2B, the driving force received by the auger screw 22 of the cleaning unit 13K is transmitted from the first pulley 39 to the second pulley 40 through the endless belt 41. The driving force transmitted to the second pulley 40 is then transmitted to the conveyor auger 31 through the first bevel gear 46 and the second bevel gear 47, as shown in FIGS. 3 and 5. The conveyor auger 31 is thus rotated by receiving the driving force from the auger screw 22 of the cleaning unit 13K.

The toner deposited on the peripheral surface of the photosensitive drum 5K (waste toner) is scraped off by the blade 20 and is stored in the cleaning frame 21.

The waste toner stored in the cleaning frame 21 is conveyed by the corresponding auger screw 22 from the one end 22A of the auger screw 22 to the other end 22B thereof in the axial direction X. In other words, the auger screw 22 conveys the waste toner removed by the blade 20 from the one end portion 5A of the photosensitive drum 5K toward the other end portion 5B thereof in the axial direction X.

The toner conveyed from the one end 22A of the auger screw 22 to the other end 22B thereof is then conveyed into the conveyor frame 30, as illustrated in FIG. 5.

Similar to the photosensitive drum 5K, the toner remaining on the peripheral surfaces of the photosensitive drums 5Y, 5M, and 5C is also conveyed to the interior of the conveyor frame 30.

The waste toner conveyed into the conveyor frame 30 is conveyed, by rotation of the conveyor auger 31, from the other end 31B of the conveyor auger 31 toward the one end 31A thereof.

As illustrated in FIGS. 4 and 5, the waste toner conveyed by the conveyor auger 31 then falls down through the discharge port 33 of the conveyor frame 30 into the waste toner container 91 to be stored therein.

5. Operational and Technical Advantages (1) According to the drum unit 1 of the embodiment, the auger screw 22 of the cleaning unit 13K is rotatable upon receipt of the driving force from the photosensitive drum 5K to convey the waste toner removed from the peripheral surface of the photosensitive drum 5K, as illustrated in FIG. 3.

As illustrated in FIGS. 2B and 6, the conveyor auger 31 is rotatable upon receipt of the driving force from the auger screw 22 of the cleaning unit 13K to convey the waste toner conveyed by the auger screw 22 of the cleaning unit 13K.

In this drum unit 1, by simply allowing the photosensitive drum 5K to receive an external force therein, the force from the photosensitive drum 5K can be transmitted to the auger screw 22 and the conveyor auger 31 of the cleaning unit 13K.

The structure for conveying the waste toner removed from the peripheral surface of the photosensitive drum 5K can be simplified.

(2) In the drum unit 1 according to the embodiment, the auger screw 22 of the cleaning unit 13K is configured to receive driving force from the photosensitive drum 5K through meshing engagement of the auger gear 24 with the drum gear 17, as illustrated in FIG. 3.

With this structure, the auger screw 22 of the cleaning unit 13K can be reliably rotated by the drive force received from the photosensitive drum 5K.

(3) In the drum unit 1 according to the embodiment, the conveyor auger 31 is configured to receive the driving force from the auger screw 22 of the cleaning unit 13K via the first pulley 39, the endless belt 41 and the second pulley 40, as illustrated in FIGS. 2B and 6.

This structure using the endless belt 41 can provide a space for arranging another member or parts between the first pulley 39 and second pulley 40, compared to a configuration using a gear train for transmitting the driving force from the auger screw 22 of the cleaning unit 13K to the conveyor auger 31.

(4) In the drum unit 1 according to the embodiment, as shown in FIGS. 2B and 6, the contact member 44 can apply tension to the endless belt 41 by configuring such that the distal end portion 61B of the rod 61 makes contact with the endless belt 41 and the spring 62 urges the rod 61.

With this configuration, the endless belt 41 can reliably transmit the driving force from the first pulley 39 to the second pulley 40.

(5) In the drum unit 1 according to the embodiment, as shown in FIG. 2B, the contact member 44 is supported by the second side plate 52 that supports the other end portion 5B of the photosensitive drum 5K.

Accordingly, positioning of the contact member 44 relative to the photosensitive drum 5K can be performed with high accuracy.

As a result, the contact member 44 can reliably apply tension to the endless belt 41.

(6) In the drum unit 1 according to the embodiment, as shown by FIGS. 2B and 6, the rod 61 is pivotably movable supported by the second side plate 52 through such a simple structure that the base end portion 61A of the rod 61 is fitted to the boss 54 of the second side plate 52.

This pivoting structure of the rod 61 about the base end portion 61A enables the rod 61 to reliably apply tension to the endless belt 41 by making the distal end portion 61B of the rod 61 contact the endless belt 41.

(7) In the drum unit 1 according to the embodiment, since the second pulley 40 and the first bevel gear 46 are integral with each other, the second pulley 40 and the first bevel gear 46 can transmit the driving force from the auger screw 22 of the cleaning unit 13K to the conveyor auger 31 with high accuracy, as illustrated in FIGS. 3 and 5.

Further, integration of the second pulley 40 and the first bevel gear 46 can reduce the number of parts and components required for manufacturing the drum unit 1.

(8) In the drum unit 1 according to the embodiment, the single bearing 49 supports both of the first bevel gear 46 and the second bevel gear 47, as illustrated in FIG. 5. This structure can realize accurate arrangement of the first bevel gear 46 and the second bevel gear 47.

As a result, transmission of the drive force from the auger screw 22 of the cleaning unit 13K to the conveyor auger 31 can be reliably performed.

6. Modifications

Various modification are conceivable to the drum unit 1 of the embodiment descried above. Hereinafter, various modifications to the depicted embodiment will be described, while like parts and components will be designated by the same reference numerals as those of the embodiment to avoid duplicating descriptions therefor.

6.1 First Modification

In the embodiment described above, in order to apply tension to the endless belt 41, the rod 61 of the contact member 44 makes contact with the lower end portion of the endless belt 41 from outward thereof, as illustrated in FIG. 2B.

Figure 8A:
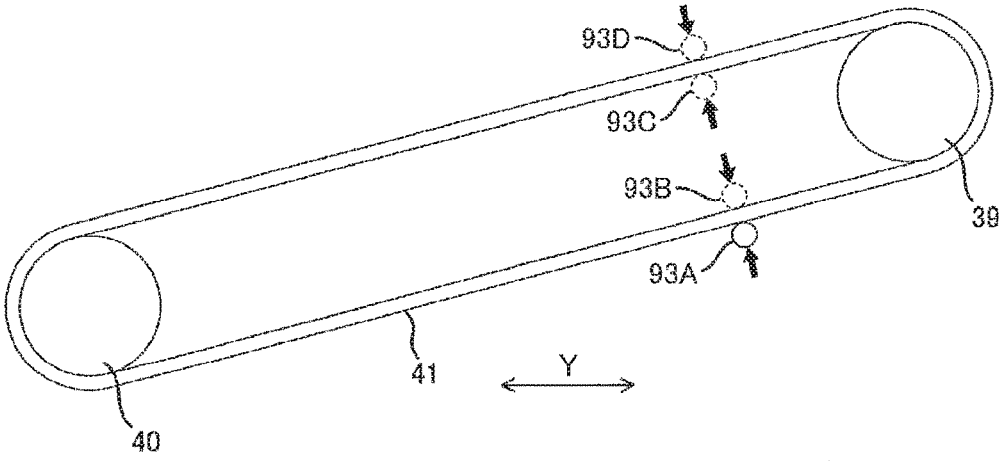
FIG. 8A is a schematic diagram illustrating a structure for applying tension to the endless belt according to a first modification to the embodiment.

Alternatively, for example, a drum shaft of the photosensitive drum 5K may be used to apply tension to the endless belt 41. In this case, referring to FIG. 8A, the drum shaft may be disposed in an inner space defined by an inner peripheral surface of the endless belt 41, or may be disposed outside of the endless belt 41 when viewed in the axial direction X. Specifically, referring to FIG. 8A, the drum shaft may be disposed outside of the endless belt 41 to make contact with the lower end portion of the endless belt 41 from outward thereof, as shown by a solid line labeled with a reference numeral 93A. Alternatively, the drum shaft may be disposed in the inner space of the endless belt 41 to make contact with the lower end portion of the endless belt 41 from inward thereof, as shown by a broken line labeled with a reference numeral 93B. Still alternatively, the drum shaft may be disposed outside of the endless belt 41 to make contact with an upper end portion of the endless belt 41 from outward thereof, as shown by a broken line labeled with a reference numeral 93D. Still alternatively, the drum shaft may be disposed in the inner space of the endless belt 41 to make contact with the upper end portion of the endless belt 41 from inward thereof, as shown by a broken line labeled with a reference numeral 93C.

In this modification, operational and technical advantages similar to those of the depicted embodiment can be obtained.

6.2 Second Modification

In the depicted embodiment, the first pulley 39 is fitted to the other end 22B of the auger screw 22, as illustrated in FIG. 2B, to transmit the driving force from the auger screw 22 to the first bevel gear 46.

Figure 8B:
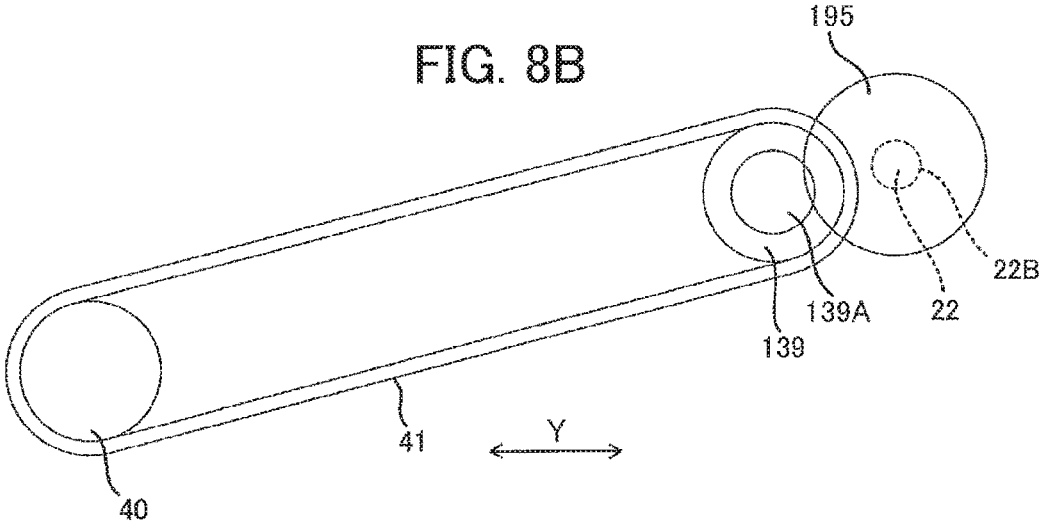
FIG. 8B is a schematic diagram illustrating a structure for transmission of the driving force via an auger gear according to a second modification to the embodiment.

FIG. 8B shows an alternative structure for transmitting the driving force from the auger screw 22 to the first bevel gear 46. In this second medication, a first pulley 139 may be provided between the auger screw 22 and the second pulley 40 in the crossing direction Y.

In this first pulley 139 according to the second modification, a protrusion 139A is provided on the first pulley 139 to protrude therefrom in the axial direction X. The protrusion 139A has a circular columnar shape. The protrusion 139A has a circumferential surface on which gear teeth are formed.

An auger gear 195 is fitted to the other end 22B of the auger screw 22. The auger gear 195 meshes with the gear teeth of the protrusion 139A on the first pulley 139.

With this structure, the driving force of the auger screw 22 of the cleaning unit 13K is transmitted to the first bevel gear 46 through the auger gear 195, the first pulley 139, the endless belt 41, and the second pulley 40.

In this second modification, operational and technical advantages similar to those of the depicted embodiment can be obtained.

6.3 Third Modification

Figure 8C:
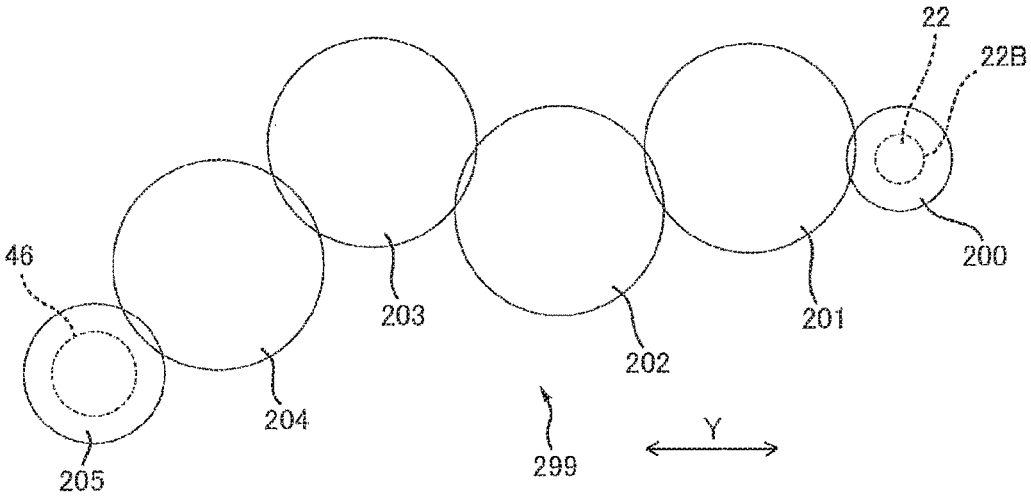
FIG. 8C is a schematic diagram illustrating a structure for transmission of the driving force via a gear train according to a third modification to the embodiment.

FIG. 8C shows another alternative structure for transmitting the driving force from the auger screw 22 to the first bevel gear 46. In this third modification, a gear train 299 is provided, instead of the first pulley 39, the second pulley 40, and the endless belt 41 of the embodiment.

Specifically, the gear train 299 includes an auger gear 200, a first idle gear 201, a second idle gear 202, a third idle gear 203, a fourth idle gear 204, and a follower gear 205.

The auger gear 200 is fitted to the other end 22B of the auger screw 22 of the cleaning unit 13K. The auger gear 200 is rotatable with the auger screw 22 of the cleaning unit 13K. The auger gear 200 is coaxial with the auger screw 22 of the cleaning unit 13K.

The first idle gear 201 is disposed between the auger gear 200 and the first bevel gear 46 in the crossing direction Y. The first idle gear 201 meshes with the auger gear 200.

The second idle gear 202 is arranged between the first idle gear 201 and the first bevel gear 46 in the crossing direction Y. The second idle gear 202 meshes with the first idle gear 201.

The third idle gear 203 is arranged between the second idle gear 202 and the first bevel gear 46 in the crossing direction Y. The third idle gear 203 meshes with the second idle gear 202.

The fourth idle gear 204 is disposed between the third idle gear 203 and the first bevel gear 46 in the crossing direction Y. The fourth idle gear 204 meshes with the third idle gear 203.

The follower gear 205 is integrally formed with the first bevel gear 46. The follower gear 205 is rotatable with the first bevel gear 46. The follower gear 205 meshes with the fourth idle gear 204.

With this structure, the driving force of the auger screw 22 of the cleaning unit 13K is transmitted to the first bevel gear 46 through the gear train 299.

In this third modification, operational and technical advantages similar to those of the depicted embodiment can be obtained.

6.4 Fourth Modification

In the embodiment described above, the conveyor auger 31 is configured to rotate upon receipt of the driving force from the photosensitive drum 5K via the auger screw 22 of the cleaning unit 13K, as illustrated in FIG. 3.

Figure 9A:
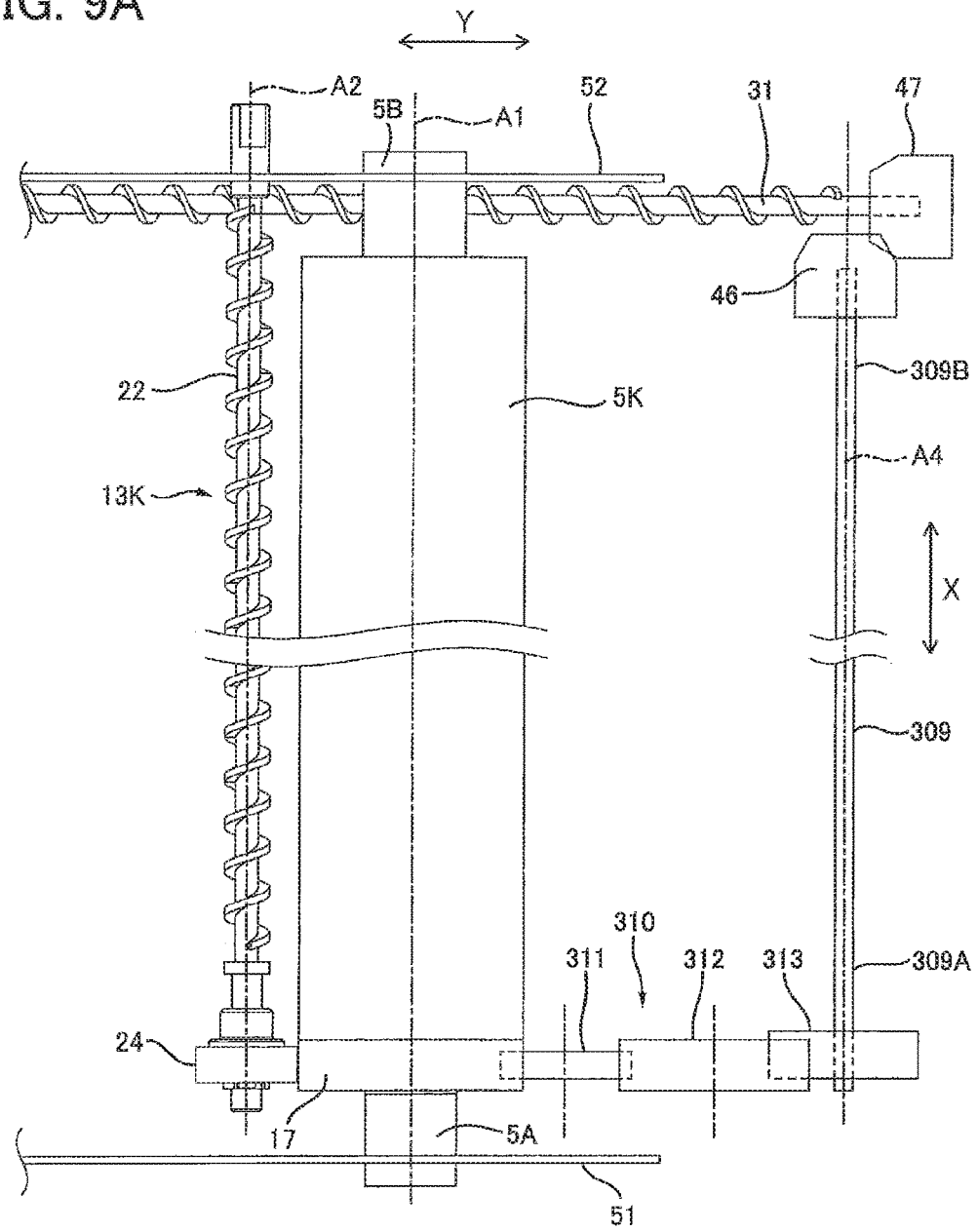
FIG. 9A is a schematic diagram illustrating a structure for transmission of the driving force via a gear train and a shaft according to a fourth modification to the embodiment.
Figure 9B:
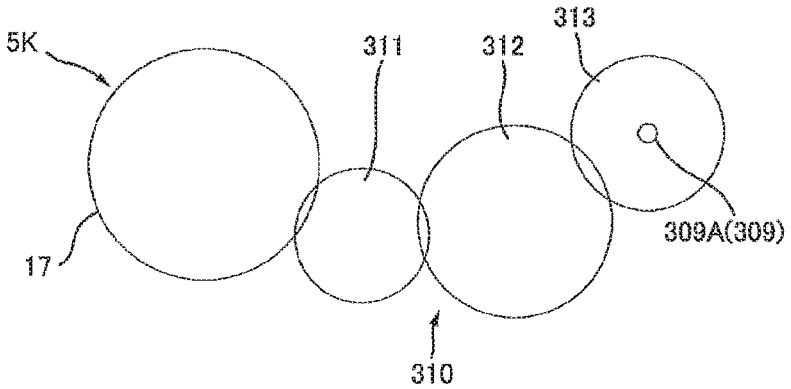
FIG. 9B is a side view illustrating the structure according to the fourth modification shown in FIG. 9A.

FIGS. 9A and 9B show an alternative structure to transmit the driving force of the photosensitive drum 5K to the conveyor auger 31. In this fourth modification, the auger screw 22 of the cleaning unit 13K is not used for transmission of the driving force to the conveyor auger 31. Rather, in this fourth modification, the conveyor auger 31 is configured to rotate upon receipt of the driving force from the photosensitive drum 5K through a shaft 309 and a gear train 310.

Specifically, referring to FIGS. 9A and 9B, the shaft 309 is provided opposite to the auger screw 22 of the cleaning unit 13K with respect to the photosensitive drum 5K in the crossing direction Y. The shaft 309 is rotatable about an axis A4 extending in the axial direction X. That is, preferably, the axis A4 is in parallel with the axis A1, as in the fourth modification.

The shaft 309 has one end 309A positioned adjacent to the first side plate 51, and another end 309B positioned adjacent to the second side plate 52 in the axial direction X. That is, the one end 309A and the other end 309B are opposite ends of the shaft 309 in the axial direction X.

The first bevel gear 46 is fitted to the other end 309B of the shaft 309. The first bevel gear 46 is rotatable with the shaft 309.

The gear train 310 includes a first idle gear 311, a second idle gear 312, and a follower gear 313. The first idle gear 311 is an example of a rotatable body.

The first idle gear 311 is arranged between the drum gear 17 and the shaft 309 in the crossing direction Y. The first idle gear 311 meshes with the drum gear 17.

The second idle gear 312 is arranged between the first idle gear 311 and the shaft 309 in the crossing direction Y. The second idle gear 312 meshes with the first idle gear 311.

The follower gear 313 is fitted to the one end 309A of the shaft 309. The follower gear 313 is rotatable with the shaft 309. The follower gear 313 is coaxial with the shaft 309. The follower gear 313 meshes with the second idle gear 312.

With this structure, the driving force of the photosensitive drum 5K is transmitted to the conveyor auger 31 through the gear train 310 and the shaft 309.

In this fourth modification, operational and technical advantages similar to those of the depicted embodiment can be obtained.

6.5 Fifth Modification

Figure 10A:
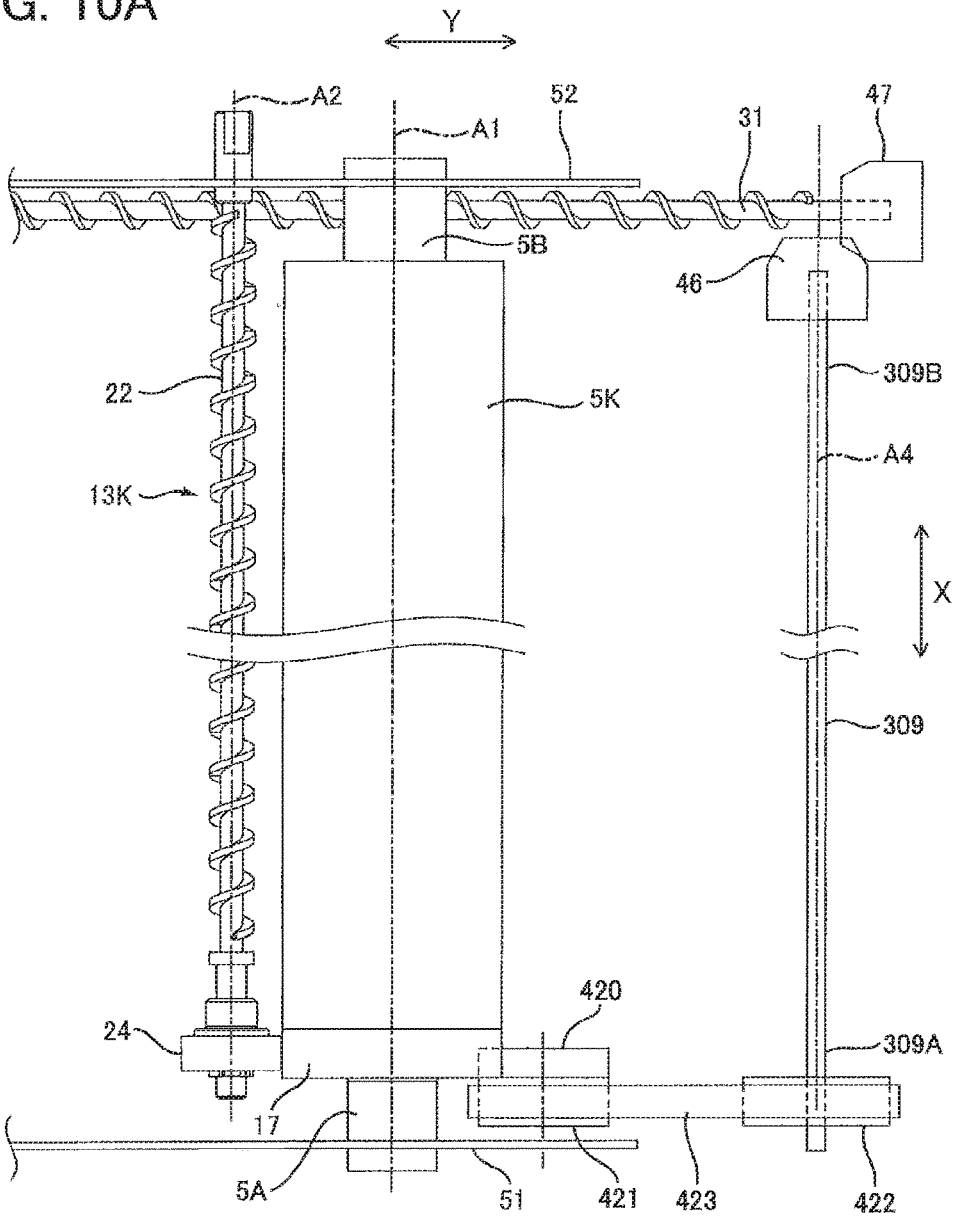
FIG. 10A is a schematic diagram illustrating a structure for transmission of the driving force via a gear, a first pulley, a second pulley, an endless belt and a shaft according to a fifth modification to the embodiment.
Figure 10B:
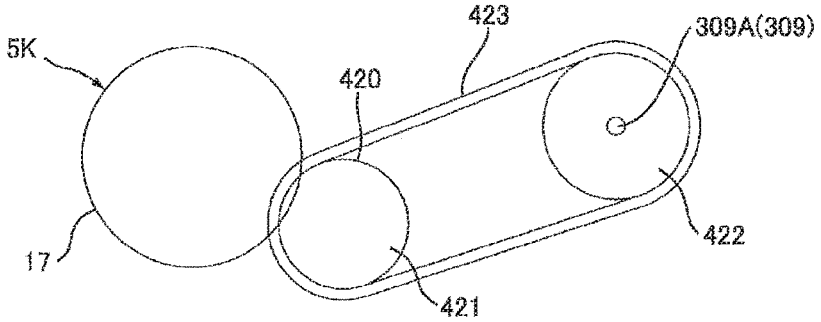
FIG. 10B is a side view illustrating the structure according to the fifth modification shown in FIG. 10A.

FIGS. 10A and 10B show another alternative structure to transmit the driving force of the photosensitive drum 5K to the conveyor auger 31. Specifically, in this fifth modification, instead of the gear train 310 of the fourth modification, a gear 420, a first pulley 421, a second pulley 422, and an endless belt 423 are provided. The shaft 309 is also provided as in the fourth modification.

The gear 420 is disposed between the drum gear 17 and the shaft 309 in the crossing direction Y. The gear 420 is in contact with and meshes with the drum gear 17 provided at the one end portion 5A of the photosensitive drum 5K. The gear 420 is another example of the rotatable body.

The first pulley 421 is formed integrally with the gear 420. The first pulley 421 is formed to protrude from the gear 420 in the axial direction X. The first pulley 421 is rotatable with the gear 420.

The second pulley 422 is fitted to the other end 309B of the shaft 309. The second pulley 422 is coaxial with the shaft 309. The fourth pulley 322 is rotatable together with the shaft 309.

The endless belt 423 is mounted over the first pulley 421 and the second pulley 422. The endless belt 123 can transmit the driving force of the first pulley 421 to the second pulley 422.

With this structure, the driving force of the photosensitive drum 5K can be transmitted to the conveyor auger 31 via the gear 420, the first pulley 421, the second pulley 422, the endless belt 423, and the shaft 309.

In this fifth modification, operational and technical advantages similar to those of the depicted embodiment can be obtained.

While the disclosure is described in detail with reference to the specific embodiment thereof while referring to accompanying drawings, it would be apparent to those skilled in the art that many modifications and variations may be made therein without departing from the scope of the disclosure.

What is claimed is:

1. A drum unit comprising:

a photosensitive drum defining an axis extending in a first direction, the photosensitive drum being rotatable about the axis, the photosensitive drum having one end portion and another end portion opposite the one end portion in the first direction;

a blade contacting a peripheral surface of the photosensitive drum and configured to remove waste toner on the peripheral surface of the photosensitive drum;

a first auger extending in the first direction and rotatable upon receipt of a driving force from the photosensitive drum, the first auger being configured to convey the waste toner removed by the blade in the first direction;

a second auger extending in a second direction crossing the first direction, the second auger being configured to convey the waste toner conveyed by the first auger in the second direction;

an auger gear coaxially provided at the first auger and configured to rotate together with the first auger;

a follower gear configured to rotate to transmit the driving force to the second auger to rotate the second auger;

an idle gear configured to rotate to transmit the driving force from the auger gear to the follower gear;

a first bevel gear rotatable together with the follower gear; and a second bevel gear coaxially provided at the second auger and rotatable with the second auger, the second bevel gear meshing with the first bevel gear.

2. The drum unit according to claim 1, wherein the photosensitive drum further includes a drum gear provided at the one end portion of the photosensitive drum, and wherein the first auger includes a gear meshing with the drum gear.

3. The drum unit according to claim 1, wherein the first bevel gear is integrally formed with the follower gear.

* * * * *